US009175675B2

(12) United States Patent
Stephens

(10) Patent No.: US 9,175,675 B2
(45) Date of Patent: Nov. 3, 2015

(54) HIGH-EFFICIENCY PUMP SYSTEMS

(75) Inventor: Lonny Stephens, Lakeside, CA (US)

(73) Assignee: LANAI POOL PUMP SYSTEMS LLC, Santee, CA (US)

( * ) Notice: Subject to any disclaimer, the term of this patent is extended or adjusted under 35 U.S.C. 154(b) by 287 days.

(21) Appl. No.: 12/506,168

(22) Filed: Jul. 20, 2009

(65) Prior Publication Data

US 2014/0123381 A1 May 8, 2014

Related U.S. Application Data

(63) Continuation-in-part of application No. 11/343,150, filed on Jan. 30, 2006, now Pat. No. 7,438,802, and a continuation of application No. 11/591,921, filed on Nov. 2, 2006, now abandoned, and a continuation-in-part of application No. 10/980,941, filed on Nov. 3, 2004, now Pat. No. 7,208,082.

(51) Int. Cl.

| | |
|---|---|
| ***F04B 17/00*** | (2006.01) |
| ***F04D 13/14*** | (2006.01) |
| ***F04B 17/03*** | (2006.01) |
| ***F04B 23/04*** | (2006.01) |
| *E03B 5/00* | (2006.01) |

(52) U.S. Cl.

CPC ..... *F04B 17/006* (2013.01); *F04B 17/03* (2013.01); *F04B 23/04* (2013.01); *F04D 13/14* (2013.01); *E03B 5/00* (2013.01); *Y10T 137/86163* (2015.04)

(58) Field of Classification Search

CPC ..... F04B 17/006; F04B 17/03; F04B 23/04; E03B 5/00; F04D 13/12; F04D 13/14; F04D 15/029

USPC ..... 417/313, 3; 29/888.021

See application file for complete search history.

(56) References Cited

U.S. PATENT DOCUMENTS

| | | | | |
|---|---|---|---|---|
| 5,118,258 | A * | 6/1992 | Martin | 417/3 |
| 6,189,811 | B1 * | 2/2001 | Rudy | 239/375 |
| 6,407,469 | B1 * | 6/2002 | Cline et al. | 307/11 |
| 7,407,371 | B2 * | 8/2008 | Leone et al. | 417/423.15 |
| 2008/0167931 | A1 | 7/2008 | Gerstenmeier et al. | |

OTHER PUBLICATIONS

Sunray Engineering "Solar Powered Pool Pumps," 2009.
Savior 5,000 gal. Solar Powered Pool Pump, NCSF5K, 2009.
Lorentz, PS 600 BADU Top 12 Battery/Solar High Volume Surface Pump, 2009.
GOL Solar Pool Pump Control, Model HWDAQSOLLVTC.

* cited by examiner

*Primary Examiner* — Charles Freay
*Assistant Examiner* — Philip Stimpert
(74) *Attorney, Agent, or Firm* — Donald L. Wenskay

(57) ABSTRACT

According to one embodiment of the present invention, a system for pumping fluid is provided. According to this embodiment, a fluid pumping system comprises a fluid inlet pipe and a fluid outlet pipe. A plurality of pump units are disposed between the inlet and outlet pipes such that the pump units each pump fluid out of the inlet pipe and into the outlet pipe. The pump units each include at least one DC motor. A solar panel may be used to power the pump units.

6 Claims, 6 Drawing Sheets

HIGH-EFFICIENCY PUMP SYSTEMS

BACKGROUND

The present invention relates to systems for pumping fluids, and more specifically, to high efficiency fluid pumping systems.

Many different kinds of systems have been developed for pumping fluids. Generally such systems include a source of power, a fluid pump and pipes to carry the fluid to and from the pumping system. Examples include pumping systems for municipal water and sewer systems, industrial pumping systems, and residential pumping systems, such as swimming pool pumps. Fluid pumping systems consume a significant portion of the power consumed by modern civilization. It has been estimated that pool pumps alone account for about 25% of the electrical usage of homes having swimming pools.

SUMMARY

According to one embodiment of the present invention, a fluid pumping system comprises: a fluid inlet pipe; a fluid outlet pipe; and a plurality of pump units disposed between the inlet and outlet pipes, the pump units each pumping fluid out of the inlet pipe and into the outlet pipe, wherein the pump units each include at least one DC motor.

According to another embodiment of the present invention, a water pump system comprises: a preexisting water pump having a first horsepower rating; and a retrofitted pump system bypassing the preexisting water pump, the retrofitted pump system comprising a plurality of pump units, each having a second horsepower rating, wherein the total horsepower rating of the plurality of the pump units in the retrofitted pump system are less than ½ the first horsepower rating.

According to a further embodiment of the present invention, a solar powered pool pump system comprises: a water inlet pipe drawing water from a pool; a water outlet pipe transferring water to the pool; a plurality of pump units disposed between the inlet and outlet pipes, the pump units each pumping fluid out of the inlet pipe and into the outlet pipe, wherein the pump units each include at least one DC motor; and a photovoltaic solar panel providing electrical power to the plurality of pump units.

DETAILED DESCRIPTION

Embodiments of the invention provide high efficiency fluid pumping systems. In some embodiments the low power requirements of the pumping systems permit the use of alternative power sources, such as DC electrical power, solar and battery power. Many prior pumping systems use relatively large fluid pumps with a relatively high gallons per hour pumping capacity. Such pumps generally require a powerful electrical motor which uses a large amount of electrical power. In many applications the power requirements of these motors necessitates the use of AC electrical power. The present inventor has invented an alternative pumping system [s] which uses less power, thereby opening up the possibilities of pumping fluids without AC power, for example, using such sources as solar, battery, low voltage DC, wind power, etc. The present invention does this by replacing (or augmenting) an existing pump system with a plurality of smaller pumps, each pump being powered by a smaller electric motor. In some embodiments, the total pumping capacity in gallons per hour may be less than the jump that is replaced. However, the reduced flow rate may be compensated for by operating the pumps for a longer period of time each day.

The exemplary embodiments described herein comprise swimming pool pumping systems. However, those skilled in the art will recognize that the principles may be adapted to other applications, such as pumping systems for ponds, fountains, water features, sump pumps, as well as other systems for pumping other fluids besides water.

Figure 1:
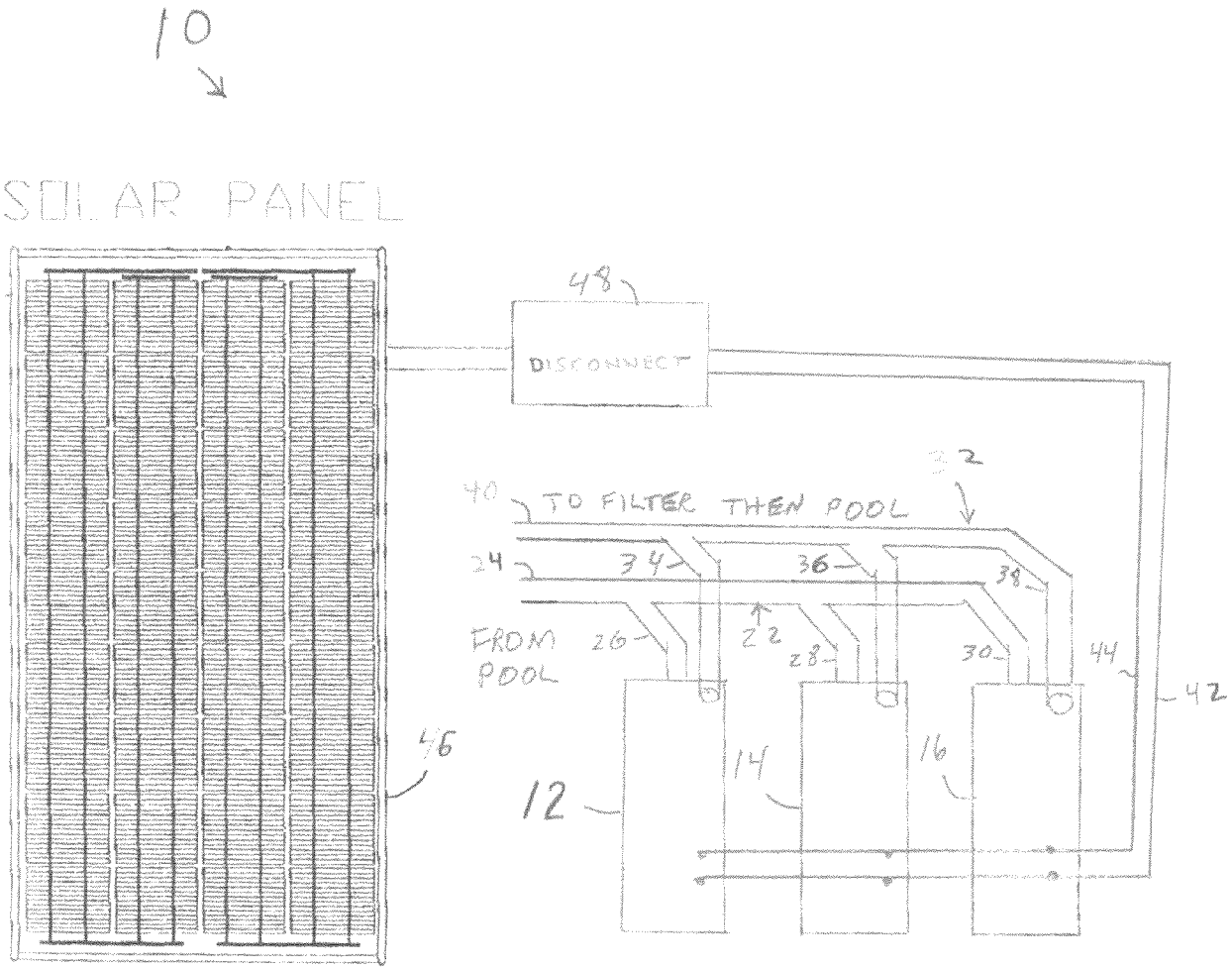
FIG. 1 shows a diagram of a solar powered pool pump system in accordance with an embodiment of the invention.
Figure 2:
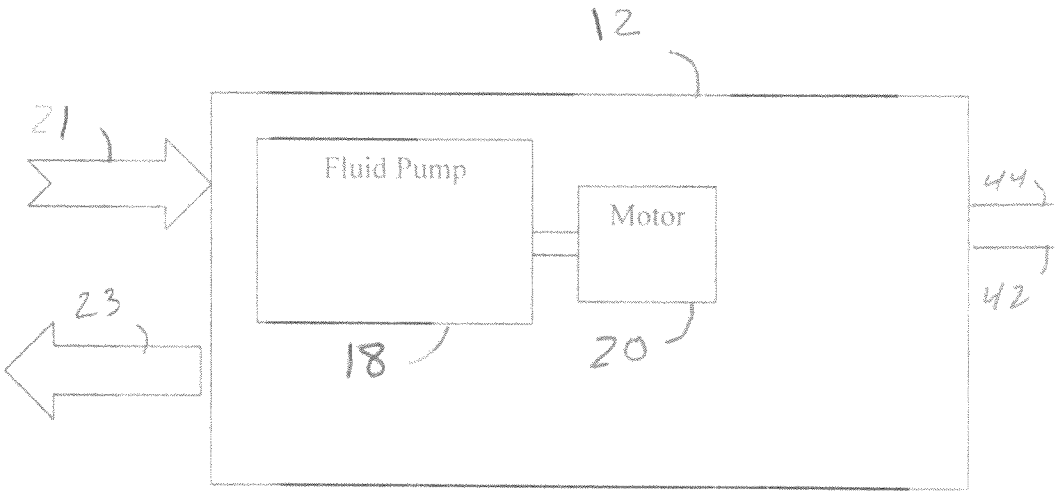
FIG. 2 shows a diagram of a pump unit used with the pump system shown in FIG. 1 in accordance with an embodiment of the invention

FIG. 1 shows a diagram of a solar powered pool pump system 10 in accordance with an embodiment of the invention. The pump system 10 includes three pump units 12, 14, and 16. As shown in FIG. 2, each pump unit 12, 14, and 16, includes a fluid pump 18 and a DC motor 20 to drive the fluid pump 18. Also shown is an inlet opening 21 for directing water into the pump unit and an outlet opening 23 for directing water out of the pump unit.

Referring again to FIG. 1, an intake manifold 22 receives water from a swimming pool (not shown) through an intake pipe 24. Three pump intake pipes 26, 28, and 30 are connected from the intake manifold 22 to each of the pump units 12, 14, and 16 respectively. Because of the negative pressure created by the pump units at its inlet 21, water will flow from the pool intake pipe 24 through the intake manifold 22 and through the pump intake pipes 26, 28, and 30 into each of the respective pump units 12, 14, and 16.

Three output pipes 34, 36, and 38 direct water from the pump outlet openings 23 to an output manifold 32. Water passing through the output manifold 32 is directed to an output pipe 40, which directs water to a pool filter (not shown) and then back to the pool.

The pump units 12, 14, and 16 receive electrical power through electrical wires 42 and 44, which are connected to a photovoltaic solar panel 46 through a disconnect switch unit 48. In this embodiment, the pump units 12, 14, and 16 may each include a 1/25 horsepower 24V DC motor rated at 48 Watts each at 1.8 Amps. One suitable pump unit for this embodiment may be the Model No. 809BRHSC 24V DC motor pump unit available from March Manufacturing Incorporated, of Glenview Ill., USA. Other size pumps may be used depending on the application. However, in the swimming pool application of the present embodiment, each pump unit will typically be in the range of 1/10 to 1/50 horsepower. This is in contrast to conventional pool pumps, which usually are rated at over 1 horsepower.

One suitable photovoltaic solar panel may be the Model No. NO244U1F available from Sharp Electronics Corporation, which is capable of producing 224 watts. The solar-powered pool pump system 10 is capable of a flow rate of 18-22 gallons per minute. The daily running time for this system 10 will depend on the size of the swimming pool and other factors. In general, however, this system 10 may provide adequate volume of recirculation for an average size pool when running between 5 hours and 10 hours per day. It may be noted that a typical pool pump with a single more powerful pump unit may provide a higher flow rate and hence, may only need to run for fewer hours per day. However the inventor has discovered that this configuration with three smaller pump units running for a longer period of time uses substantially less electricity per day, for an equivalent number of gallons of water re-circulated per day, as described in more detail below.

The embodiment in FIG. 1 may be more suitable for environments where the sun shines very consistently. However, in other environments, where there are more cloudy days, the system 10 shown in FIG. 1 may not run when the sun is not shining. In such cases, where the system 10 has been retrofitted to an existing conventional pool pump system powered by AC current, the conventional pump system may need to be operated on cloudy days. In order to extend the operating time of the system 10 to account for cloudy days, an alternative system with battery backup may be used.

Figure 3:
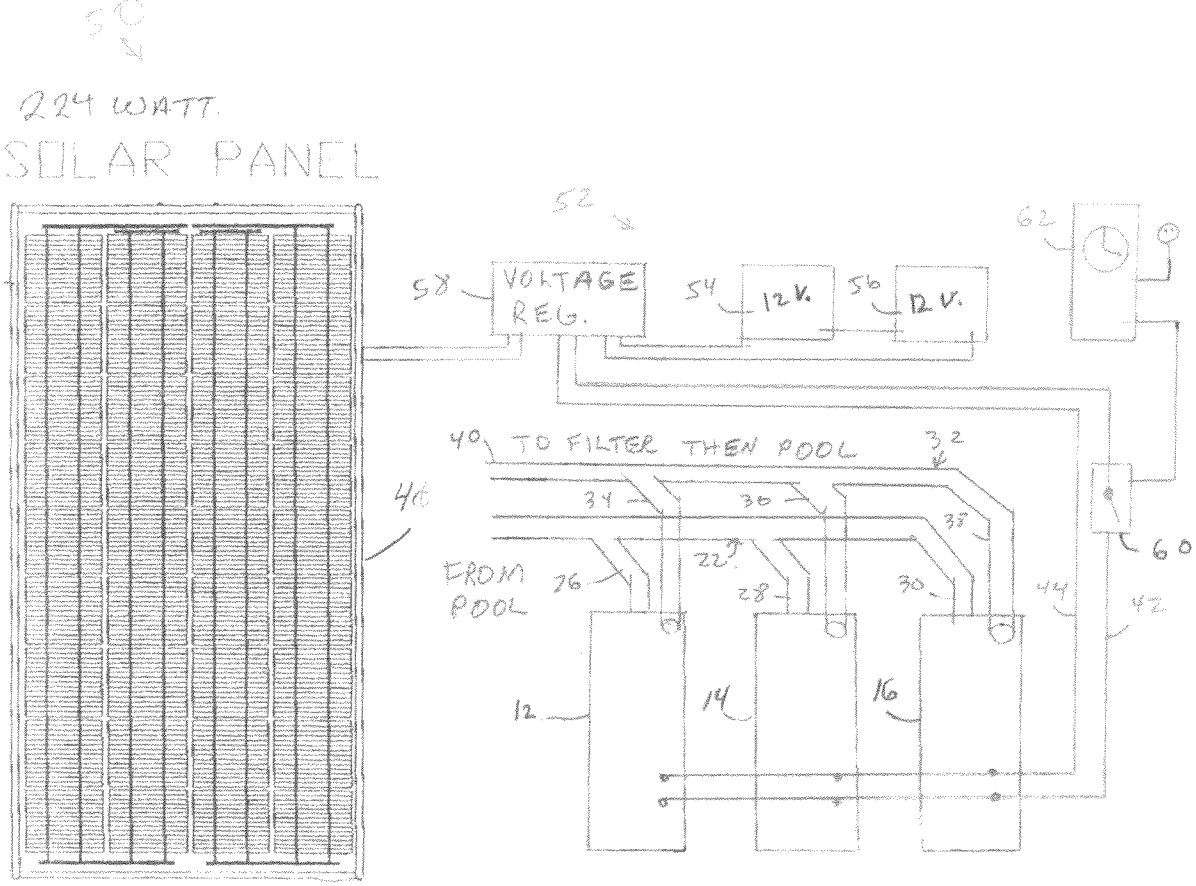
FIG. 3 shows a diagram of a solar powered pool pump system with battery backup in accordance with an embodiment of the invention.

For example, FIG. 3 shows a diagram of a solar powered pool pump system 50 with battery backup in accordance with an embodiment of the invention. The like numbered components in this system 50 which are also shown in FIG. 1 may be the same components as described above. The system 50 shown in FIG. 3, however, includes a battery back up system 52, which includes a pair of sealed 12 V batteries 54 and 56, a voltage regulator 58, a relay 60 and a timer 62. In this configuration, when the sun is shining the solar panel 46 will produce about 80 Watts in surplus electrical power, which may be used to charge the batteries 54 and 56. The voltage regulator 58 is used to control of the electricity generated by solar panel 46 to direct the appropriate amount to the pump units 12, 14, and 16 and to the batteries 54 and 56. The timer 62 and relay 60 are used to control the number of hours that the batteries 54 and 56 are operated. It will be appreciated that it is preferable not to drain the batteries down completely. Thus the timer 62 can be used to set the maximum number of hours that the batteries may be operated in a day. When that number of hours is reached the timer 62 will send a signal to the relay 60 to shut down the pumps 12, 14, and 16.

Because of the battery backup system 52, when the sun is not shining and the solar panel 46 does not generate enough electricity to run the pump units 12, 14 and 16, the pumps may be operated from electricity stored in the batteries 54 and 56. In this embodiment, the sealed batteries 54 and 56 may comprise 12V 26 AH sealed Absorbed Glass Matt (AGM) batteries Model Number 12260-D5747 available from UPG Incorporated. The voltage regulator may comprise a Model PR1010 charge controller available from Steca Company of Germany. The timer 62 may comprise a Model 2EO21 time clock available from the Granger Company. The relay 60 may comprise a model 2CF88 available from the granger Company.

Figure 4:
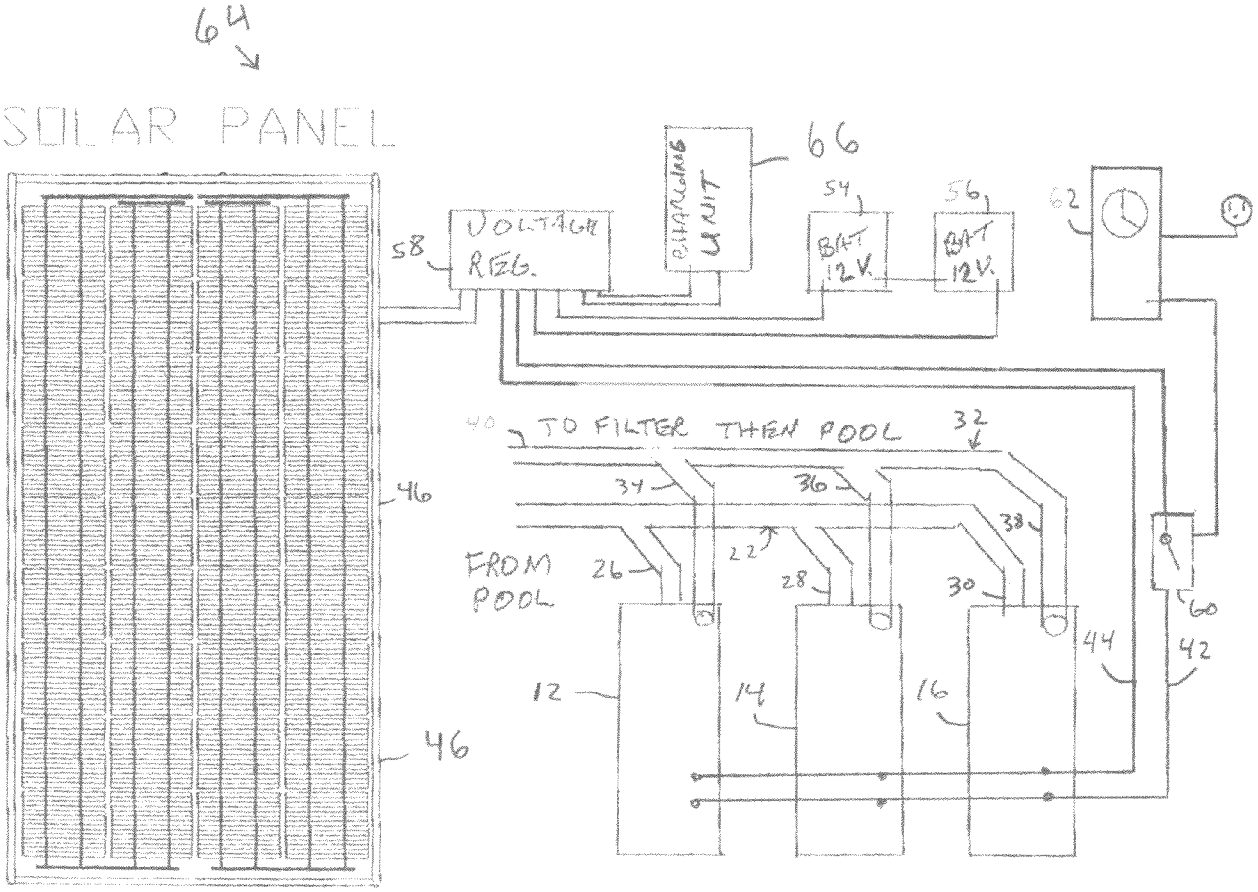
FIG. 4 shows a diagram of a solar powered pool pump system with rechargeable battery backup in accordance with an embodiment of the invention.

FIG. 4 shows a diagram of a solar powered pool pump system 64 with rechargeable battery backup in accordance with an embodiment of the invention. In this embodiment, the components are identical to those in the system 50 with the addition of a battery charging unit 66 attached to the voltage regulator 58. The battery charging unit 66 may be operated off of 120V house current. In this system 64, when there is not enough sunlight to for the solar panel to generate enough electrical power to recharge the batteries, the batteries may be charged using the battery charging unit 66. The battery charging unit may comprise a model SEC2415A available from Samlex American Company. In some embodiments, the output of the solar panel may be improved by using a tracking device (not shown), which tilts the solar panel toward the sun as it moves across the sky each day. One such tracking device may be the Model UTR-020 tracker available from Zomeworks Corporation.

Figure 5:
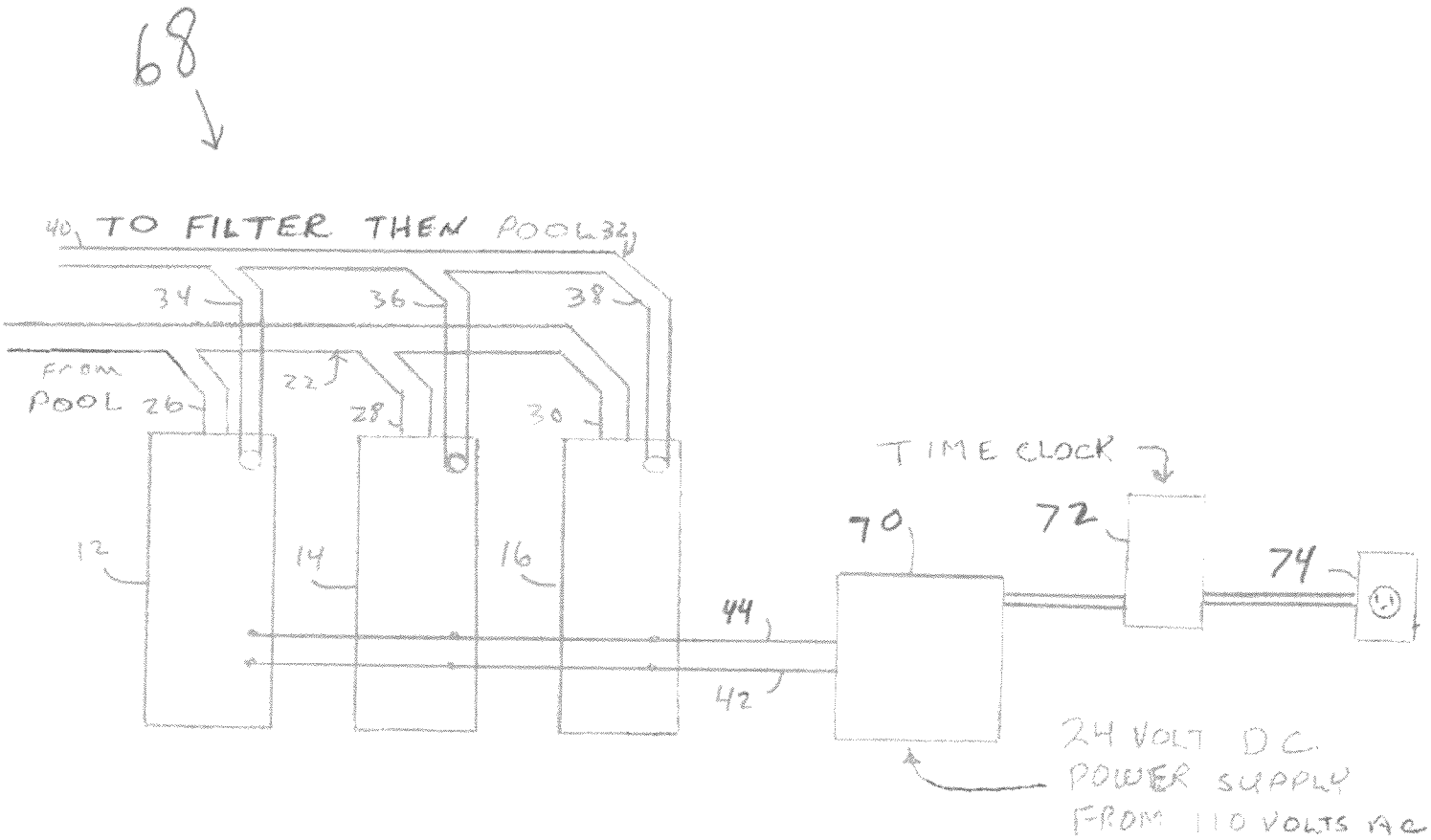
FIG. 5 shows a diagram of a non-solar powered pool pump system in accordance with an embodiment of the invention.

FIG. 5 shows a diagram of a non-solar powered pool pump system 68 in accordance with an embodiment of the invention. This system 68 would be applicable for areas where there may be insufficient sunlight to use the systems shown in FIGS. 1-3. In this embodiment, the solar panel is replaced by a 24 V DC power supply unit 70 that provides the necessary electrical power to drive the pump units 12, 14, and 16. The power supply unit 70 receives its power from a 120V AC outlet 74 and may be controlled by a time clock 72. It is noted that, even without using a solar panel the system 68 provides significant savings in electrical power due to the above-discussed efficiencies resulting from the use of three relatively small pumps and by having the pumps run for a longer period of time per day than conventional pool pumps.

Figure 6:
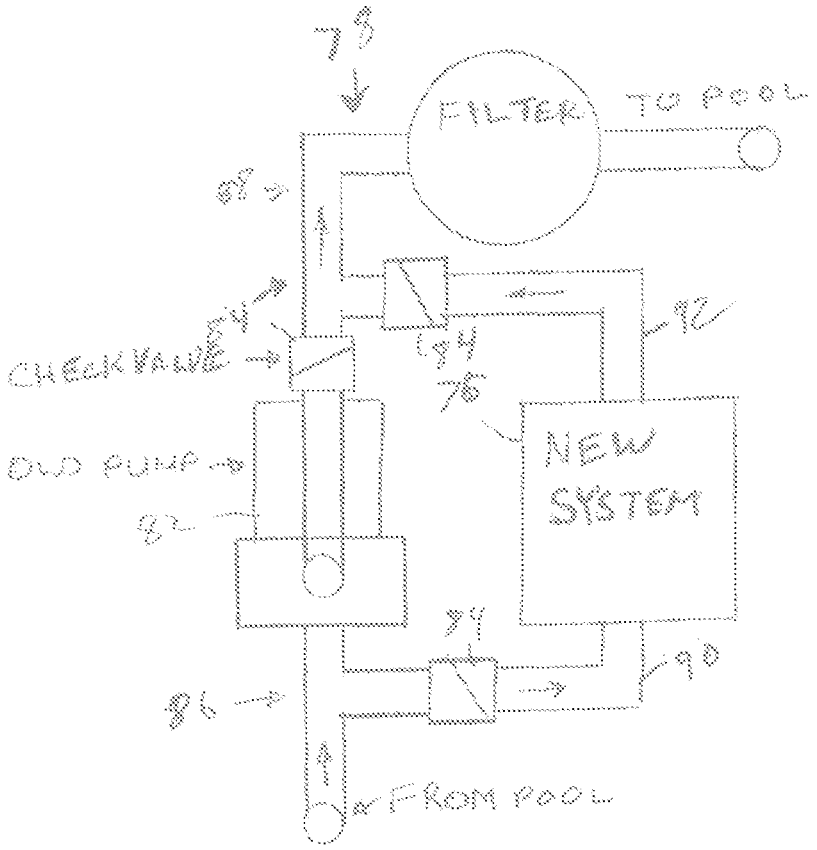
FIG. 6 shows a diagram of a retrofit application of a solar powered pool pump system in accordance with an embodiment of the invention.

FIG. 6 shows a diagram of a retrofit application of a solar powered pool pump system 76 in accordance with an embodiment of the invention. In many instances the present invention may be retrofitted to an existing swimming pool filter and recirculation system 78. This existing system 78 includes a filter 80, an existing jump 82, a check valve 84, inlet pipes 86 and outlet pipes 88. The new pump system 76 may comprise any embodiment of the present invention, such as those shown in FIGS. 1-5. The new pump system 76 is configured to bypass the existing pump 82 by means of inlet 90 and output 92 bypass pipes. Control over whether the new pump system 76 or the existing pump 82 is used may be achieved by using check valves 84 to either block or permit water to pass through either pump.

The existing pump 82 will typically be a larger pump and will be useful to perform vacuuming of the pool, since vacuuming may require a higher flow rate than the new system 76 may provide. In some embodiments a flow meter (not shown) may be useful to determine the flow rate to insure that there is adequate daily recirculation of the pool water. It will be appreciated that the size of the pipes is an important consideration in designing a pool pumping system. In the examples shown, it is assumed that pipes having 1½ inch inside diameter are used. This is a common pipe size used in existing pool systems. For other diameter pipes, the size of the particular pumps and other system parameters may need to be modified to optimize efficiency. Also it may be noted that a different number of pumps besides three may be employed. However, the present inventor has found the optimum results with three pumps.

Tests have shown embodiments of the invention to achieve substantial energy savings. For example, a typical conventional pool pump system was tested. This system used a 1½ horsepower pump and operated 6 hours a day and used 1,533 watts per hour. This would add up to 3,312,000 watts per year. At a cost of $0.29 per kilowatt, this would cost $960.48 per year to operate. Alternatively, the conventional pool pump may operate for 8 hours per day, which would cost $1,280.35 per year to operate.

In contrast, in tests on an embodiment of the invention, three 144 Watt rated pump units operated a rate of 117 watts per hour, and moved about 1800 gallons per hour. This test system and was operated for about 8.75 hours per day, which is adequate for most swimming pools. The system thus consumed about 1,023 watts per day, which adds up to 368,280 watts per year. At a cost of $0.29 per kilowatt, this would cost only $106.72, as compared to $960.48 or $1,280.35 in the conventional systems described above.

As can be seen from the above disclosure, embodiments of the invention provide fluid pumping systems that are highly efficient as compared to conventional pumping systems, thereby reducing energy consumption. If the present invention were widely adopted there would be a substantial reduction in the overall energy usage. As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." From the above description, it can be seen that the present invention provides a system and method for implementing the embodiments of the invention. References in the claims to an element in the singular is not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of 35 U.S.C. section 112, sixth paragraph, unless the element is expressly recited using the phrase "means for" or "step for."

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A water pump system comprising:

a preexisting water pump system including a preexisting water pump having a first horsepower rating; and a supplemental retrofitted pump system selectively bypassing said preexisting water pump system, said supplemental retrofitted pump system comprising:

inlet bypass pipe;

outlet bypass pipe;

a plurality of check valves configured to periodically direct water away from the preexisting water pump system and through the supplemental retrofitted pump system and also to periodically direct water away from the supplemental retrofitted pump system and back through the preexisting water pump system; and one or more pump units, each having a second horsepower rating, wherein the total horsepower rating of the one or more pump units in the supplemental retrofitted pump system is less than ½ of said first horsepower rating, wherein the water pump system further comprises a photovoltaic solar panel providing electrical power to said one or more pump units.

2. The water pump system according to claim 1 further comprising a battery storing electrical power generated by said photovoltaic solar panel.

3. The water pump system according to claim 2 further comprising a battery charging unit for recharging said battery, wherein the battery charging unit receives electrical power from a source other than said photovoltaic panel.

4. The water pumping system according to claim 1 further comprising a power supply unit for providing electrical power to said one or more pump units, said power supply unit receiving electrical power from an AC source.

5. A method for circulating water to a pool comprising:

installing a supplemental retrofitted pump system in a preexisting water pump system, wherein the preexisting water pump system includes a preexisting water pump having a first horsepower rating, wherein the supplemental retrofitted pump system includes an inlet bypass pipe, an outlet bypass pipe, and a plurality of check valves;

using the check valves to periodically direct water away from the preexisting water pump system and through the supplemental retrofitted pump system and also to periodically direct water away from the supplemental retrofitted pump system and back through the preexisting water pump system; and wherein the supplemental retrofitted pump system includes one or more pump units, each having a second horsepower rating, wherein the total horsepower rating of the one or more pump units in the supplemental retrofitted pump system is less than ½ of said first horsepower rating, further comprising a photovoltaic solar panel providing electrical power to said one or more pump units.

6. The method of claim 5 wherein the flow rate of the supplemental retrofitted pump system is less than that of the preexisting water pump system.

* * * * *